United States Patent [19]

Wilson

[11] 3,950,027

[45] Apr. 13, 1976

[54] ARMREST FOR DENTAL CHAIR

[75] Inventor: David Barry Wilson, Holcomb, N.Y.

[73] Assignee: Sybron Corporation, Rochester, N.Y.

[22] Filed: Oct. 15, 1974

[21] Appl. No.: 514,667

[52] U.S. Cl. ..... 297/416; 108/142; 248/118; 248/418; 297/417; 403/96; 403/97

[51] Int. Cl.[2] ..... A47C 7/54

[58] Field of Search..... 297/36, 37, 113, 115–117, 297/160–162, 411, 412, 416, 417, 422, 429; 403/93, 96, 97; 248/118, 118.1, 415, 416, 425, 409, 418; 16/143; 108/142; 269/328

[56] References Cited

UNITED STATES PATENTS

| | | | |
|---|---|---|---|
| 495,914 | 4/1893 | Smart | 403/97 X |
| 613,633 | 11/1898 | King et al. | 403/97 X |
| 1,158,599 | 11/1915 | Wall | 16/143 X |
| 1,693,782 | 12/1928 | Hasselkus | 108/142 |
| 1,885,384 | 11/1932 | Snow | 16/143 X |
| 3,829,159 | 8/1974 | Leffler | 297/417 |

*Primary Examiner*—Roy D. Frazier
*Assistant Examiner*—William E. Lyddane
*Attorney, Agent, or Firm*—Theodore B. Roessel; Roger Aceto

[57] ABSTRACT

An armrest for dental chairs and the like can be rotated 90° in a horizontal plane about a vertical axis to permit easier entry and exit of a patient to and from the chair. The armrest is automatically locked at either the forward position or the 90° position and is unlocked simply by lifting vertically on the armrest. A single set screw for connecting the armrest to the dental chair not only makes the armrest operable but also allows the armrest to be offered as an optional feature of the dental chair.

7 Claims, 4 Drawing Figures

FIG. 1
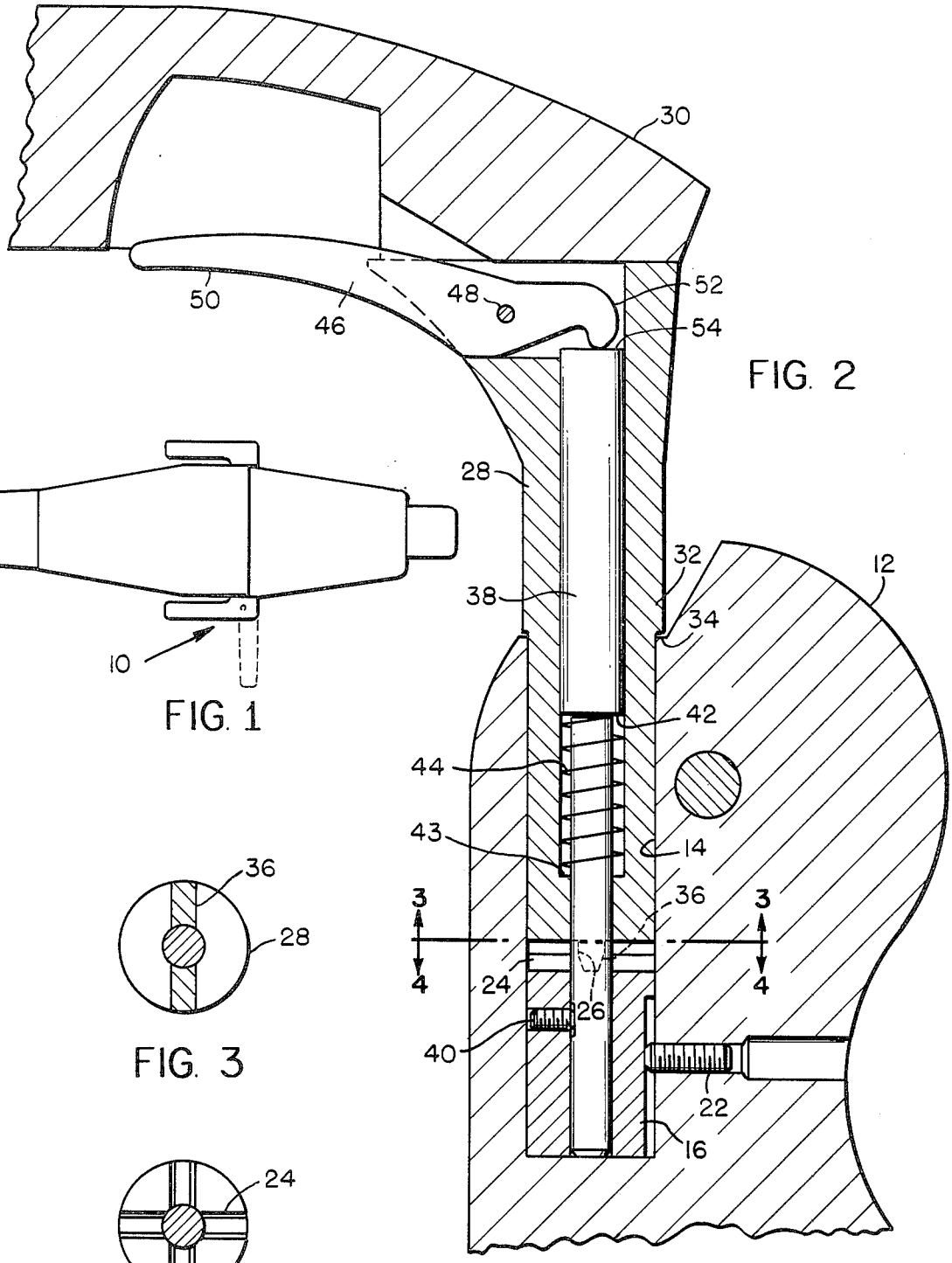
FIG. 2
FIG. 3
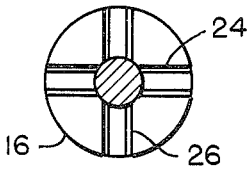
FIG. 4

ARMREST FOR DENTAL CHAIR

BACKGROUND OF THE INVENTION

The present invention relates generally to armrests for dental chairs and the like and more specifically to an armrest which can be rotated about a vertical axis 90° to facilitate the entry and exit of a patient into and out of a chair and which can be readily removed from the dental chair so that the armrest may be offered as an optional feature.

Adjustable armrests are well known to the prior art. For example, one type simply rotates in a vertical plane about a horizontal axis either upwardly or downwardly in order to remove the armrest from the patient's path as he enters or exits the dental chair. When such armrests are in the out-of-the-way position, they can offer no support function. In other words, an elderly or infirm patient cannot grasp such an armrest for support as he enters or leaves the chair.

The armrest of the present invention is designed to rotate in a horizontal plane about a vertical axis. Thus the armrest can be moved from a first, normal, position wherein it is aligned with the dental chair to a position 90° removed wherein it is generally perpendicular to the dental chair. Further, the armrest is firmly and positively locked in both its positions so that it can be grasped and can provide support for an elderly and infirm patient entering or leaving the dental chair. The armrest can be easily unlocked and operated simply by lifting on the armrest and in one embodiment mechanical advantage means can be provided to facilitate this operation.

SUMMARY OF THE INVENTION

The present invention may be characterized as one aspect thereof by the provision of an adjustable armrest for dental chairs and the like comprising a first upright member fixed to the dental chair, the member having a cruciate groove in the upper face thereof with one portion of the groove being oriented parallel to the axis of the chair and the other oriented normal to the axis of the chair; a second upright member axially aligned with the first and rotatable with the respect to the chair about a vertical axis, the second member carring the armrest adjacent an upper portion thereof and having its lower face provided with a tongue adapted to engage one or the other of the groove portions on the first member; and bias means urging the second member towards the first to maintain the engagement of the tongue and groove, the armrest being operated by an axial pull to move the second member against the bias and disengage the tongue and one groove portion and thereafter rotating the arm until the tongue on the second member comes into registery with the other groove portion.

OBJECTS OF THE INVENTION

One object of the present invention is to provide an armrest for a dental chair which can be moved so as to facilitate the entry and exit of a patient to and from the chair.

Another object of the present invention is to provide an armrest of the type described which is rotatable in a horizontal plane about a vertical axis.

A further object of the present invention is to provide an armrest for a dental chair which is rotatable in a horizontal plane about a vertical axis between a normal and an out-of-the-way position, the armrest automatically locking when either position is reached.

A still further object of the present invention is to provide an armrest for a dental chair which can provide support for a patient sitting in the chair or for a patient entering or leaving the chair.

A yet further object of the present invention is to provide an armrest which is quickly and easily attached to a dental chair.

These and other objects, advantages and characterizing features of the present invention will become more apparent upon consideration of the following detailed description thereof when taken in connection with the accompanying drawings depicting the same.

DESCRIPTION OF THE DRAWINGS

FIG. 1 is a plan view of a dental chair incorporating the armrests of the present invention;

FIG. 2 is a elevation view on an enlarged scale partly broken away and in section showing a portion of the dental chair with the armrest in place; and FIGS. 3 and 4 are views taken along line 3—3 and 4—4 respectively of FIG. 2.

DESCRIPTION OF THE PREFERRED EMBODIMENTS

Referring to the drawings, FIG. 1 shows a dental chair in plan view having armrests of the present invention generally indicated at 10. The figure shows the range of movement provided by the armrest of the present invention in that the armrest is capable of moving from a first position shown in solid line, wherein the armrest is in a normal position and oriented parallel to the long axis to the dental chair, to a second position shown in dotted line wherein the armrest is perpendicular to the axis of the dental chair. When the armrest is in this second position, it is out of the way so that a patient can more easily enter and exit the chair. Furthermore, with the armrest positively locked in this second position, it provides a convenient, firm support which can be grasped by an elderly or infirm patient leaving or entering the chair.

As shown in FIG. 2, the portion in the dental chair to which the armrest is attached is in a generally upright member indicated at 12. Member 12 has a vertical bore 14 extending part way into the member for slidably receiving the armrest of the present invention. The armrest itself includes a first sleeve 16 held in the bore by any convenient means such as a set screw 22. The upper face of sleeve 16 is provided with two intersecting grooves 24 and 26 best shown in FIG. 4. One of the grooves 24, is oriented generally parallel to the axis of the dental chair while the other groove 26 is oriented normal to the axis of the dental chair.

A second upright sleeve member 28 is slidably inserted into bore 14. Sleeve member 28 carries adjacent its upper end the upholstered armrest portion 30. A flange 32 on sleeve member 28 is adapted to engage a corresponding shoulder 34 on upstanding member 12 so as to properly position sleeve 28. The sleeve carries on its lower face a tongue 36 oriented generally along the diameter of the sleeve. This tongue is adapted to engage one or the other of grooves 24 and 26 for locking the armrest either in the normal position shown in solid line in FIG. 1 or in a out-of-the-way position shown in dotted line in the figure. Preferably tongues 36 and grooves 24, 26 are configured with vertical side wall portions as shown in the drawings so as to provide a positive lock with this configuration a side load alone i.e. a load directed perpendicular to the plane of the wall will not cause disengagement and instead, the armrest 30 must be lifted in order to disengage the tongue and groove and move the arm. Thus, any accidental movement of the armrest is avoided.

Extending axially into both sleeve members 16 and 28 is an upright rod 38. The rod is pinned to the lower sleeve member 16 by any suitable means, such as set screw 40. While sleeve member 16 is fixed to the rod, sleeve member 28 can rotate about the rod and slide axially with respect to the rod. Intermediate its ends, the rod has a shoulder 42. A coil spring member 44 disposed about the rod is biased between shoulder 42 and an internal shoulder 43 on sleeve 28 so as to normally urge the sleeve downward into an engagement with sleeve 16 so that the lower face of sleeve 28 abuts the upper face of sleeve 16.

In operation and to move the armrest to the out-of-the-way position the patient or dentist simply lifts on armrest 30, this causes sleeve 28 to move axially with respect to rod 38 against the bias of spring 44. As sleeve 28 is lifted, tongue 36 comes out of engagement with groove 26 on the lower sleeve 16. The armrest can now be rotated 90 to the position shown in dotted line in FIG. 1 and released. Under the urging of gravity and the bias of spring 44, sleeve 28 is moved axially toward the lower sleeve 16 so as to engage tongue 36 with groove 24. This engagement locks the arm at the 90° or out-of-the-way position shown in dotted line in FIG. 1. When locked in this position, the bias of spring 44 maintains the engagement of the tongue and groove so that, the armrest is stable and fixed against rotation. With this arrangement, the armrest may provide support for an elderly or infirm patient entering or leaving the dental chair.

As an optional feature, the armrest may be provided with a mechanical advantage means to assist in the operation. For example, as is shown in FIG. 2 a lever arm 46 pinned at 48 to the upper portion of the sleeve 28. One end 50 of the lever arm operates as a trigger mechanism and the other end 52 of the arm bears against the top surface 54 of rod 38. When trigger 50 is pulled upward as may occur for example, by grasping both the armrest 30 and trigger 50 and squeezing, the connection at 48 will cause the upper sleeve 28 to lift. In this respect, end 52 of the lever arm acts as a fulcrum which bears against surface 54. Since the length of the trigger portion 50 is greater than the distance between pin 48 and end 52, the mechanical advantage provided reduces the force necessary to move sleeve 28 against gravity and the bias of spring 44.

Thus, it should be appreciated that the present invention accomplishes its intended objects in providing an armrest which is quickly and easily operated to move the armrest between an in use and an out-of-use position. Further, the armrest is positively locked in either of these two positions so that it not only provides support for the patient in the chair, but also for the patient entering or leaving the chair. Also, the design of the armrest of the present invention allows the armrest to be sold as an optional item and no modification of the dental chair is required in order to permit it to receive the armrest. In this respect, should the dentist not require an armrest, a decorative cap or plug (not shown) can be inserted to cover the opening of bore 14. On the other hand, if an armrest is desired, the armrest assembly is simply inserted into bore 14 and a single set screw 22 used to fix lower sleeve 16 and therefor the armrest to the dental chair.

Having thus described the invention in detail, what is claimed as new is:

1. An adjustable armrest assembly including locking means for attachment as an assembly to a dental chair having a vertical bore to receive said assembly, said assembly comprising:

a. a first sleeve member having an outer diameter substantially equal to the bore and adapted to be inserted into and fixed within the bore to connect said assembly to said dental chair;

b. an upright rod fixed to and upstanding axially from said first sleeve member;

c. a second sleeve member having an outer diameter substantially equal to the bore and carried by said rod, a portion of said second sleeve member being adapted to be disposed in the bore and being rotatable about said rod and axially movable along said rod to abut said first sleeve member;

d. an armrest attached to said second sleeve member, said armrest being rotatable with said second sleeve member between a first in-use position and a second, out-of-the-way position;

e. lock means on said first and second sleeve members cooperating to prevent rotation of said second sleeve member when said armrest is at either said first or second position; and f. bias means between said upright rod and second sleeve member urging said second sleeve member towards said first sleeve member for engaging said lock means, said armrest being lifted vertically to move said second sleeve member axially on said rod against said bias means and disengage said lock means.

2. An adjustable armrest as in claim 1 in which said first sleeve has a flange intermediate its ends adapted to engage a shoulder about the bore for locating said first sleeve member in the bore.

3. An adjustable armrest as in claim 1 in which said rod and second sleeve members have opposed shoulders, said bias means being a coil spring disposed about said rod and biased between said shoulders.

4. An adjustable armrest as in claim 1 in which said lock means comprises a tongue on the lower face of said second sleeve member and a pair of intersecting grooves on the upper face of said first sleeve member adapted to receive said tongue, one of said grooves being oriented parallel to the axis of the dental chair and a second of said grooves being oriented normal to the axis of the dental chair.

5. An adjustable armrest as in claim 1 in which both of said grooves and said tongue have substantially vertical side wall portions which cooperate to prevent disengagement by a load applied perpendicular to the plane of said side walls.

6. An adjustable armrest as in claim 1 including a mechanical advantage means connected to said second sleeve member to facilitate the lifting of said armrest to disengage said lock means.

7. An adjustable armrest as in claim 6 in which said mechanical advantage means includes a lever arm pinned intermediate its ends to said second sleeve, one end of said lever arm bearing on the upstanding end of said rod and acting as the fulcrum of said lever.

* * * * *